US007757305B2

(12) United States Patent
Toso

(10) Patent No.: US 7,757,305 B2
(45) Date of Patent: Jul. 20, 2010

(54) LOWER BODY GARMENT WITH INTEGRAL BACK SUPPORT

(75) Inventor: Victor Toso, St. Paul, MN (US)

(73) Assignee: Nada Concepts, Inc., St. Paul, MN (US)

( * ) Notice: Subject to any disclaimer, the term of this patent is extended or adjusted under 35 U.S.C. 154(b) by 1114 days.

(21) Appl. No.: 11/031,768

(22) Filed: Jan. 7, 2005

(65) Prior Publication Data

US 2006/0150293 A1 Jul. 13, 2006

(51) Int. Cl.
*A41D 1/06* (2006.01)

(52) U.S. Cl. ..... 2/79

(58) Field of Classification Search ..... 2/69, 2/69.5, 102, 108, 94, 79, 227, 228, 238
See application file for complete search history.

(56) References Cited

U.S. PATENT DOCUMENTS

| | | | |
|---|---|---|---|
| 6,385 | A | 4/1849 | Pollard et al. |
| 68,521 | A | 9/1867 | Manley |
| 324,498 | A | 8/1885 | Surbaugh |
| 485,277 | A | 11/1892 | Hunter |
| 504,598 | A | 9/1893 | Leyda |
| 633,012 | A | 9/1899 | Depue |
| 846,562 | A | 3/1907 | Grayson |
| 879,534 | A | 2/1908 | Fraser |
| 1,015,812 | A | 6/1912 | Madsen |
| 1,065,022 | A | 6/1913 | Bell |
| 1,266,374 | A | 5/1918 | Ziegler |
| 1,678,584 | A | 7/1928 | Branson |
| 2,056,767 | A | 10/1936 | Blath |
| 2,100,597 | A | 11/1937 | Pickle et al. |
| 2,250,267 | A | 7/1941 | Lins |
| 2,280,274 | A | 3/1942 | Wildermuth |
| 2,418,009 | A | 3/1947 | Berman |
| 2,722,974 | A | 11/1955 | Stagner |
| 2,741,412 | A | 4/1956 | Hinkle |
| 2,939,462 | A | 6/1960 | McClung |
| 2,948,898 | A | 8/1960 | Allen |
| 2,966,906 | A | 1/1961 | Wiltrout |
| 3,142,351 | A | 7/1964 | Green |
| 3,143,748 | A | 8/1964 | Manning |
| 3,215,469 | A | 11/1965 | Wamsley |

(Continued)

FOREIGN PATENT DOCUMENTS

| | | |
|---|---|---|
| DE | 3607296 | 3/1986 |

(Continued)

*Primary Examiner*—Tejash Patel
(74) *Attorney, Agent, or Firm*—Crompton, Seager & Tufte LLC

(57) ABSTRACT

A garment comprising first and second lower leg portions each having a distal and a proximal end, each lower leg portion including an anchor disposed proximate the distal end thereof, a first keeper fixed to the first lower leg portion proximate the proximal end thereof, a second keeper fixed to the second lower leg portion, proximate the proximal end thereof, an elongate lumbar support assembly having a first end and a second end, a first mating member disposed at the first end of the elongate lumbar support assembly and adapted to releaseably mate with the first keeper, and a second mating member disposed at the second end of the elongate lumbar support assembly and adapted to releaseably mate with the second keeper.

18 Claims, 6 Drawing Sheets

U.S. PATENT DOCUMENTS

| | | | | |
|---|---|---|---|---|
| 3,295,517 | A | | 1/1967 | Stevens |
| 3,794,381 | A | | 2/1974 | Caldemeyer |
| 3,850,167 | A | | 11/1974 | Seeley |
| 4,010,744 | A | | 3/1977 | Boyen |
| 4,065,180 | A | | 12/1977 | Karay |
| 4,132,229 | A | | 1/1979 | Morrison |
| 4,183,578 | A | | 1/1980 | Naganawa |
| 4,185,673 | A | | 1/1980 | Daniello |
| 4,190,918 | A | | 3/1980 | Harvell |
| 4,223,670 | A | | 9/1980 | Cramer |
| 4,240,663 | A | | 12/1980 | Locher |
| 4,247,064 | A | | 1/1981 | Schulman et al. |
| 4,324,012 | A | | 4/1982 | Cannaday |
| 4,339,151 | A | | 7/1982 | Riggs |
| 4,422,454 | A | | 12/1983 | English |
| 4,456,086 | A | | 6/1984 | Wier et al. |
| 4,471,993 | A | | 9/1984 | Watson |
| 4,475,543 | A | | 10/1984 | Brooks et al. |
| 4,505,705 | A | | 3/1985 | Matthews et al. |
| 4,545,614 | A | | 10/1985 | Abu-Isa et al. |
| 4,623,194 | A | | 11/1986 | Pillot |
| 4,627,109 | A | | 12/1986 | Carabelli et al. |
| 4,738,545 | A | | 4/1988 | Westgor |
| 4,759,754 | A | | 7/1988 | Korpman |
| 4,762,364 | A | | 8/1988 | Young |
| 4,763,952 | A | | 8/1988 | Gaudreau, Jr. |
| 4,773,106 | A | | 9/1988 | Toso et al. |
| 4,809,804 | A | | 3/1989 | Houston et al. |
| 4,813,080 | A | | 3/1989 | Toso |
| 4,819,846 | A | | 4/1989 | Hannemann |
| 4,913,136 | A | | 4/1990 | Chong |
| 4,925,242 | A | | 5/1990 | Harris et al. |
| 4,934,005 | A | | 6/1990 | Martin et al. |
| 4,948,156 | A | | 8/1990 | Fortner |
| 5,001,791 | A | | 3/1991 | Toso |
| 5,054,852 | A | | 10/1991 | Tholkes |
| 5,062,414 | A | | 11/1991 | Grim |
| 5,083,554 | A | | 1/1992 | Toso |
| 5,086,759 | A | | 2/1992 | Buddingh |
| 5,111,806 | A | | 5/1992 | Travis |
| 5,147,261 | A | | 9/1992 | Smith et al. |
| 5,167,203 | A | | 12/1992 | Scott |
| 5,188,586 | A | | 2/1993 | Castel et al. |
| 5,201,448 | A | | 4/1993 | Schue |
| 5,235,714 | A | | 8/1993 | Toso |
| 5,244,222 | A | | 9/1993 | Benoit |
| 5,256,119 | A | * | 10/1993 | Tudor ..... 482/74 |
| 5,308,147 | A | | 5/1994 | Tseng |
| 5,308,305 | A | * | 5/1994 | Romney ..... 482/124 |
| 5,334,134 | A | | 8/1994 | Saunders |
| 5,375,279 | A | | 12/1994 | Toso |
| RE34,883 | E | | 3/1995 | Grim |
| 5,399,150 | A | | 3/1995 | Saunders |
| 5,452,476 | A | | 9/1995 | Jenks |
| 5,536,246 | A | | 7/1996 | Saunders |
| 5,547,461 | A | | 8/1996 | Levis |
| 5,643,184 | A | | 7/1997 | Toso |
| 5,778,452 | A | * | 7/1998 | Dicker et al. ..... 2/69 |
| 5,857,947 | A | * | 1/1999 | Dicker et al. ..... 482/124 |
| 6,068,606 | A | | 5/2000 | Castel et al. |
| 6,083,183 | A | | 7/2000 | Yang |

FOREIGN PATENT DOCUMENTS

| | | |
|---|---|---|
| DE | 3903388 | 8/1990 |
| FR | 621843 | 2/1927 |
| FR | 960101 | 4/1950 |
| FR | 1186413 | 8/1959 |
| FR | 2557780 | 7/1985 |
| GB | 188750 | 11/1922 |
| SU | 587924 | 1/1978 |

* cited by examiner

LOWER BODY GARMENT WITH INTEGRAL BACK SUPPORT

FIELD OF THE INVENTION

The present invention relates generally to back support devices. More particularly, the present invention relates to garments which provide support for the lumbar region of the human back.

BACKGROUND OF THE INVENTION

Many popular activities require participants to be seated upright for an extended length of time without a rigid back support. Examples of activities which require an individual to be seated upright for an extended length of time include canoeing, fishing, hunting, boating, horseback riding, and motorcycling. Many people find sitting for an extended length of time with no back support to be very uncomfortable. Unfortunately, this discomfort may distract from their enjoyment of these activities. This discomfort may also cause them to reduce the amount of time they spend engaged in those activities. For example, on a long motorcycle journey, frequent stops may be required because of discomfort in the lower back. The frequency and severity of discomfort may be increased due to improper posture and/or a weak back structure.

SUMMARY OF THE INVENTION

The present invention relates generally to back support devices. More particularly, the present invention relates to garments which may be worn on the human body which provide support for the lumbar region of the back. A garment in accordance with the present invention includes a plurality of anchors which are disposed about the feet of the person wearing the garment. In the one embodiment of the present invention, each anchor comprises a stirrup.

A garment in accordance with the present invention further includes a plurality of upper leg portions, each having a proximal end and a distal end. The distal end of each upper leg portion is fixed to a lower leg portion proximate its proximal end. The proximal end of each upper leg portion is fixed to a lumbar support member. In one embodiment of the present invention, the lumbar support member is comprised of a plurality of panels fixed to each other by a lace. The lumbar support member also has a first end and a second end.

The garment includes a first belt portion having a fixed end and a free end, and defining a plurality of holes. The fixed end of first belt portion is fixed to first end of lumbar support member. The garment also includes a second belt portion having a free end and a fixed end which is fixed to second end of lumbar support member. A buckle is disposed at the free end of the second belt portion. The buckle is adapted to releaseably mate with the holes defined by the first belt portion.

The garment further includes a first stay having a fixed end and a free end. The fixed end of the first stay is fixed to the first end of the lumbar support member. The garment also includes a second stay having a fixed end and a free end. The fixed end of the second stay is fixed to the second end of the lumbar support member. The lumbar support member, the first stay, and the second stay collectively form a lumbar support assembly.

A mating member is disposed proximate the distal end of the first stay. Likewise, an additional mating member is disposed proximate the distal end of the second stay. Each mating member is adapted to releaseably mate with a keeper. At least one keeper is fixed to each lower leg portion proximate its proximal end. In one embodiment, each keeper includes a locking member and a fixing strap having two ends. The fixing strap is threaded through the locking member, and the ends of the strap are fixed to lower leg portion.

DETAILED DESCRIPTION OF THE INVENTION

The following detailed description should be read with reference to the drawings, in which like elements in different drawings are numbered identically. The drawings which are not necessarily to scale, depict selected embodiments and are not intended to limit the scope of the invention. Examples of constructions, materials, dimensions, and manufacturing processes are provided for selected elements. Those skilled in the art will recognize that many of the examples provided have suitable alternatives which may be utilized.

Figure 1:
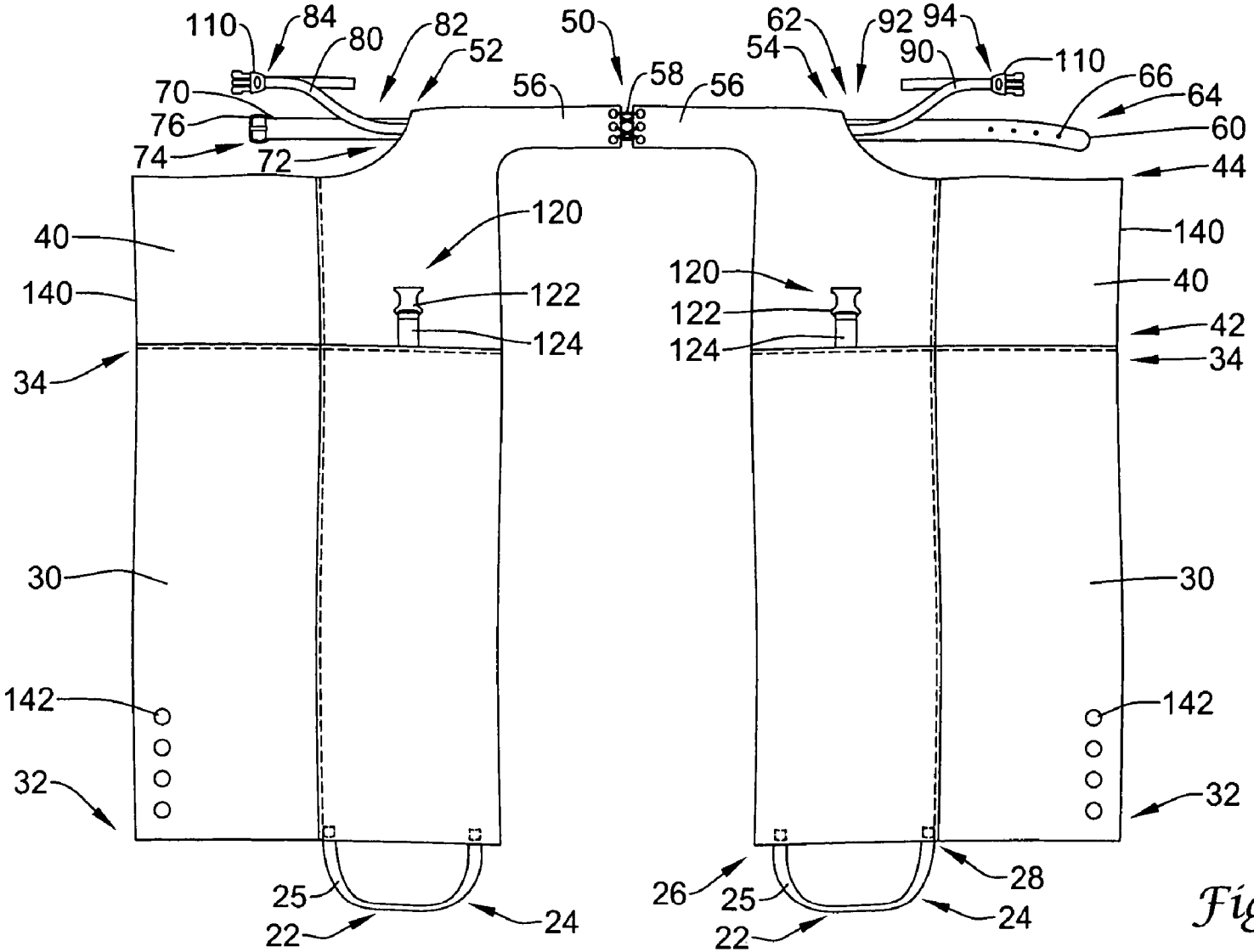
FIG. 1 is a plan view of a garment in accordance with the present invention.

FIG. 1 is a plan view of a garment 20 in accordance with the present invention. Garment 20 is generally adapted to be worn on the human body. Garment 20 includes a plurality of anchors 22 which are disposed about the feet of the person wearing garment 20. In the embodiment of FIG. 1, each anchor 22 comprises a stirrup 24. Each stirrup 24 comprises a strap 25 having a first end 26 and a second end 28. As shown in FIG. 1, first end 26 and second end 28 of each strap is fixed to a lower leg portion 30 proximate its distal end 32. Those of skill in the art will appreciate that other embodiments of anchors 22 are possible without deviating from the spirit and scope of the present invention. Examples of anchors which may be suitable in some applications include hooks, shoes, boots, and socks.

Garment 20 further includes a plurality of upper leg portions 40, each having a distal end 42 and a proximal end 44. As shown in FIG. 1, the distal end of each upper leg portion 40 is fixed to a lower leg portion 30 proximate its proximal end 34. Those of skill in the art will appreciate that other embodiments of lower leg portions 30 and upper leg portions 40 are possible without deviating from the spirit and scope of the present invention. For example, embodiments of garment 20 have been envisioned in which lower leg portions 30 and upper leg portions 40 are coextensive.

In the embodiment of FIG. 1, the proximal end 44 of each upper leg portion is fixed to a lumbar support member 50. Lumbar support member 50 is comprised of a plurality of panels 56 fixed to each other by a lace 58. Lumbar support member 50 also includes a first end 52 and a second end 54.

Garment 20 includes a first belt portion 60 having a fixed end 62 and a free end 64, and defining a plurality of holes 66. As shown in FIG. 1, fixed end 62 of first belt portion 60 is fixed to second end 54 of lumbar support member 50. Garment 20 also includes a second belt portion 70 having a free end 74 and a fixed end 72 which is fixed to first end 52 of lumbar support member 50. A buckle 76 is disposed at free end 74 of second belt portion 70. Buckle 76 is adapted to releaseably mate with holes 66 defined by first belt portion 60 forming a belt assembly.

Garment 20 of FIG. 1 includes a first stay 80 having a fixed end 82 and a free end 84. Fixed end 82 of the first stay 80 is fixed to lumbar support member 50 proximate its first end 52. Garment 20 also includes a second stay 90 having a fixed end 92 and a free end 94. Fixed end 92 of second stay 90 is fixed to second end 54 of lumbar support member 50. Lumbar support member 50, first stay 80, and second stay 90 collectively form a lumbar support assembly 100.

A mating member 110 is disposed proximate free end 84 of first stay 80. Likewise, an additional mating member 110 is disposed proximate free end 94 of second stay 90. Each mating member 110 is adapted to releaseably mate with a keeper 120. At least one keeper 120 is fixed to each lower leg portion 30 proximate proximal end 34. In the embodiment of FIG. 1, each keeper 120 includes a locking member 122 and a fixing strap 124 having two ends. Fixing strap 124 is threaded through locking member 122, and the ends are fixed to lower leg portion 30. In a presently preferred embodiment, the ends of fixing strap 124 are fixed to lower leg portion 30 by sewing. Those of skill in the art will appreciate that other elements may be utilized to attach the ends of fixing strap 124 to lower leg portion 30 without deviating from the spirit and scope of the present invention. Examples of elements which may be suitable in some applications include: rivets, eyelets, staples, pins, adhesives, buttons, hooks, and eyes.

In a presently preferred embodiment, first stay 80 and a second stay 90 are comprised of webbing. Also in a presently preferred embodiment mating member 110 comprises the male portion of a two-part buckle. In this presently preferred embodiment, locking member 122 comprises the female portion of a two-part buckle. Suitable buckles and webbing are commercially available from American Cord and Webbing Company of Woonsocket, R.I.

Those of skill in the art will appreciate that first stay 80 and second stay 90 may be comprised of other materials without deviating from the spirit and scope of the present invention. Examples of suitable materials include cord, chain, cable, wire, cloth, and leather straps. Likewise, other embodiments of mating member 110 and keeper 120 may be utilized without deviating from the spirit and scope of the present invention. For example, one embodiment of garment 20 has been envisioned in which first stay 80 is comprised of a chrome plated metal chain, mating member 110 is comprised of a chrome plated metal hook, and keeper 120 is comprised of a chrome plated metal ring.

Lower leg portions 30, upper leg portions 40, and lumbar support member 50 may be comprised of any material. Examples of materials which may be suitable in some applications include synthetic fabric, cotton fabric, linen, wool, and leather. In a presently preferred embodiment, lower leg portions 30, upper leg portions 40, and lumbar support member 50 are all comprised of leather.

In the embodiment of FIG. 1, a zipper 140 and a plurality of snaps 142 are disposed along the edges of upper leg portions 40 and lower leg portions 30. Zipper 140 and snaps 144 may be used to selectively join the edges of each leg portion, to form a generally tubular structure. Those of skill in the art will appreciate that other methods of fastening edges may be utilized without deviating from the spirit and scope of the present invention. Examples of fasteners which may be suitable in some applications include buttons, rivets, stitches, VELCRO, hooks and eyes.

Figure 2:
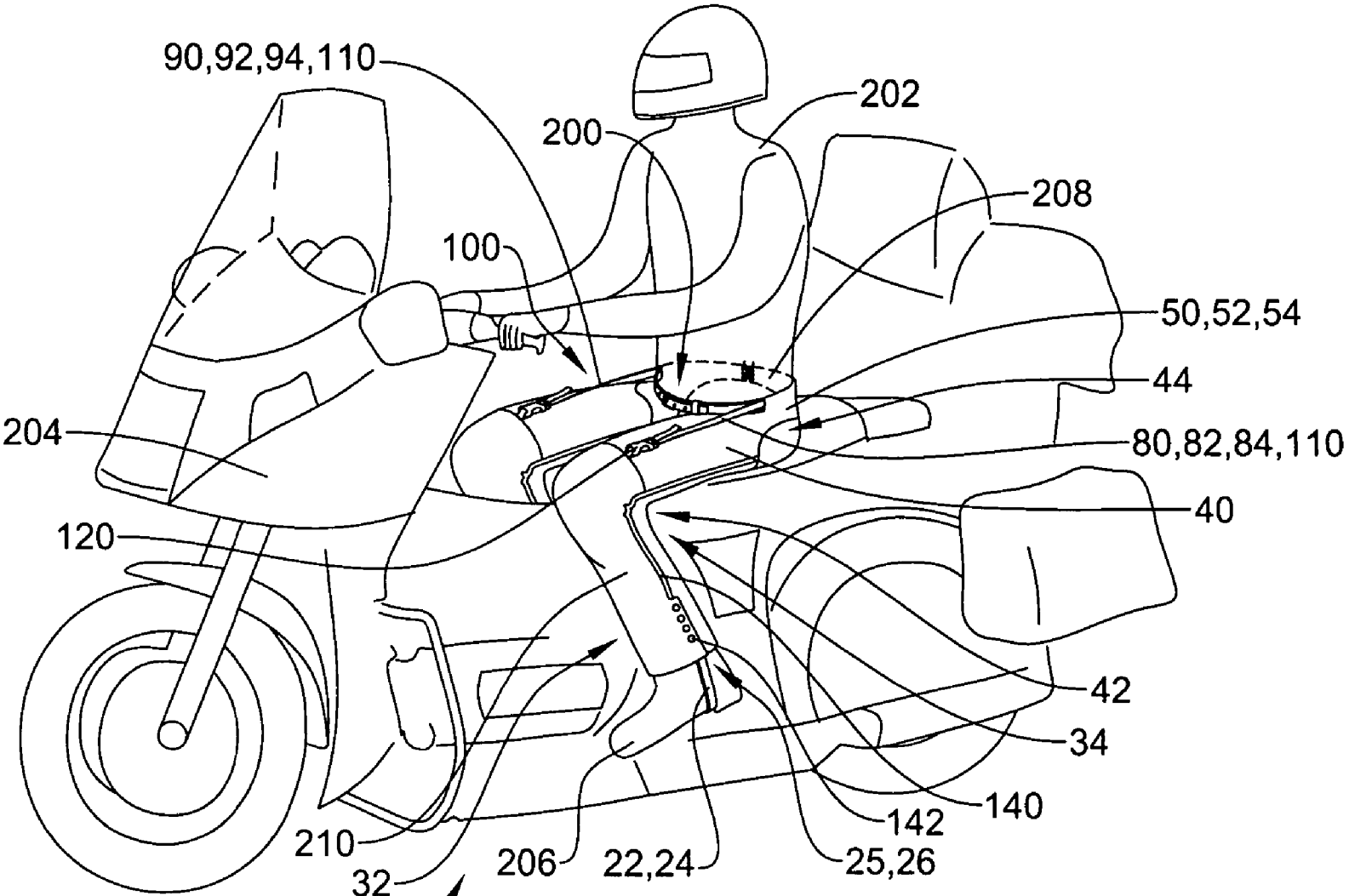
FIG. 2 is a perspective view of a human operating a motorcycle.

FIG. 2 is a perspective view of a human 202 operating a motorcycle 204. Human 202 is wearing a garment 20 in accordance with the present invention. Garment 20 includes a plurality of anchors 22. One anchor 22 is disposed about a foot 206 of human 202. In the embodiment of FIG. 2, each anchor 22 comprises a stirrup 24. Each stirrup 24 comprises a strap 25 having a first end 26 and a second end 28 (not shown). As shown in FIG. 2, first end 26 of strap 25 is fixed to a lower leg portion 30 proximate its distal end 32.

Garment 20 further includes a plurality of upper leg portions 40, each having a distal end 42 and a proximal end 44. As shown in FIG. 2, the distal end of each upper leg portion 40 is fixed to a lower leg portion 30 proximate its proximal end 34.

Garment 20 includes a belt assembly 200 and a lumbar support member 50. In the embodiment of FIG. 2, belt assembly 200 and lumbar support member 50 are both disposed about a waist 208 of human 202.

Garment 20 of FIG. 2 includes a lumbar support assembly 100. Lumbar support assembly 100 includes lumbar support member 50, a first stay 80 and a second stay 90. First stay 80 includes a fixed end 82 and a free end 84. Fixed end 82 of first stay 80 is fixed to lumbar support member 50 proximate a first end 52 thereof. Second stay 90 includes a fixed end 92 and a free end 94. Fixed end 92 of second stay 90 is fixed to second end 54 of lumbar support member 50.

A mating member 110 is disposed proximate free end 84 of first stay 80. Likewise, an additional mating member 110 is disposed proximate free end 94 of second stay 90. In the embodiment of FIG. 2, each mating member 110 has been releaseably coupled to a keeper 120. In the embodiment of FIG. 2, one keeper 120 is fixed to each lower leg portion 30 its proximate proximal end 34.

A zipper 140 and a plurality of snaps 142 are disposed along the edges of upper leg portions 40 and lower leg portions 30. In the embodiment of FIG. 2, zipper 140 and snaps 144 have been used to selectively join the edges of each leg portion, to form a generally tubular structure disposed about legs 210 of human 202.

Figure 3:
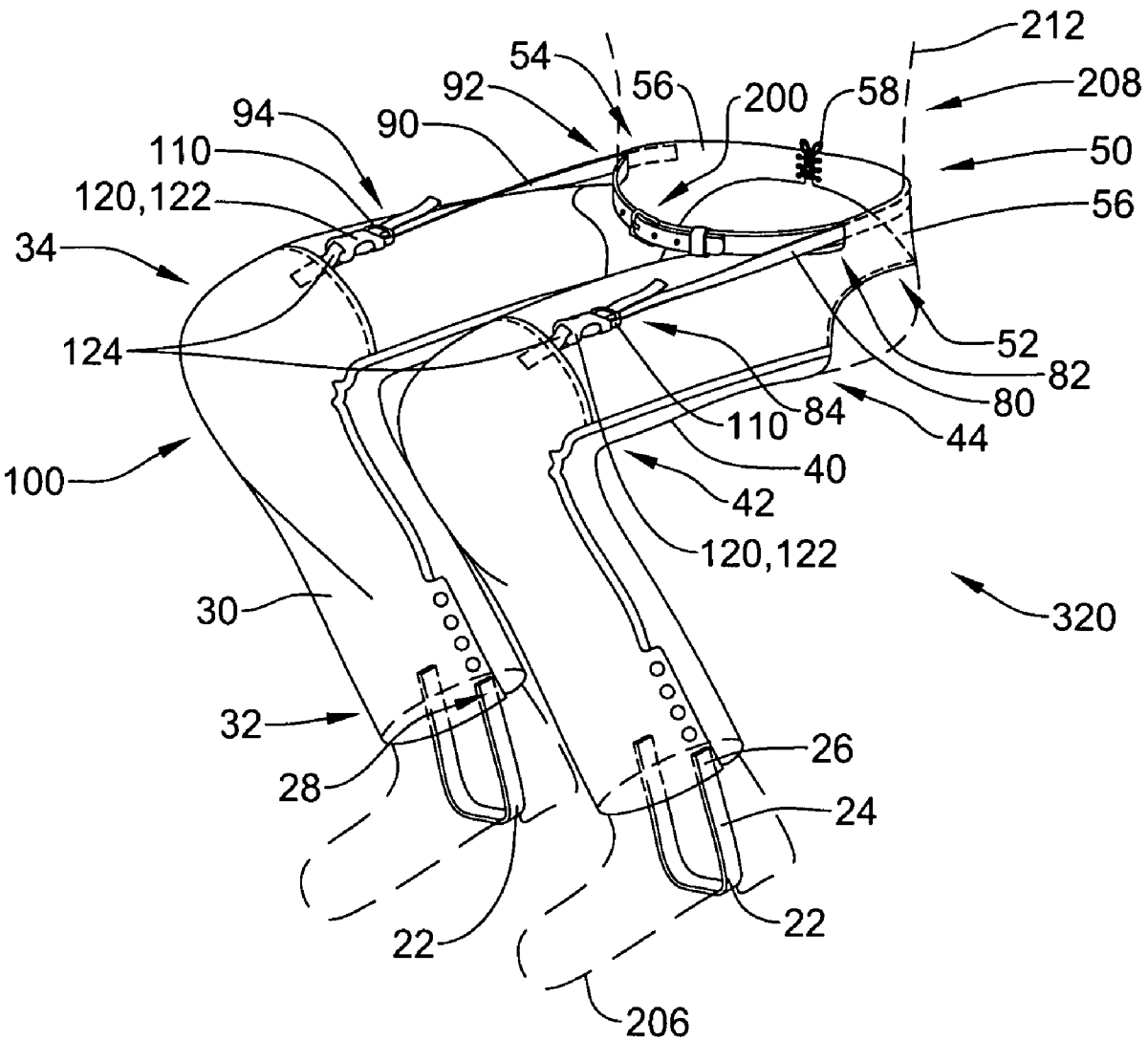
FIG. 3 is a perspective view of a garment in accordance with the present invention disposed about a human figure.

FIG. 3 is a perspective view of a garment 320 in accordance with the present invention. In FIG. 3, garment 320 is disposed about a human figure 212 shown with phantom lines. Garment 320 includes a plurality of anchors 22 disposed about a plurality of feet 206 of human figure 212. In the embodiment of FIG. 3, each anchor 22 comprises a stirrup 24. Each stirrup 24 comprises a strap 25 having a first end 26 and a second end 28. First end 26 and second end 28 of strap 25 are both fixed to a lower leg portion 30 proximate its distal end 32.

Garment 320 further includes a plurality of upper leg portions 40, each having a distal end 42 and a proximal end 44. As shown in FIG. 3, the distal end of each upper leg portion 40 is fixed to a lower leg portion 30 proximate its proximal end 34. Garment 320 includes a belt assembly 200 and a lumbar support member 50. In the embodiment of FIG. 3, belt assembly 200 and lumbar support member 50 are both disposed about a waist 208 of human figure 212. Lumbar support member 50 is comprised of a plurality of panels 56 fixed to each other by a lace 58.

Lumbar support member 50 also includes a first end 52 and a second end 54. First end 52 of lumbar support member 50 is fixed to a fixed end 82 of a first stay 80. Second end 54 of lumbar support member 50 is fixed to a fixed end 92 of a second stay 90. Lumbar support member 50, first stay 80, and second stay 90 collectively form a lumbar support assembly 100.

A mating member 110 is disposed proximate a free end 84 of first stay 80. Likewise, an additional mating member 110 is disposed proximate a free end 94 of second stay 90. In the embodiment of FIG. 3, each mating member 110 has been releaseably coupled to a keeper 120.

In the embodiment of FIG. 3, one keeper 120 is fixed to each lower leg portion 30 its proximate proximal end 34. In the embodiment of FIG. 3, each keeper 120 includes a locking member 122 and a fixing strap 124 having two ends. Fixing strap 124 is threaded through locking member 122, and the ends are fixed to lower leg portion 30.

Figure 4:
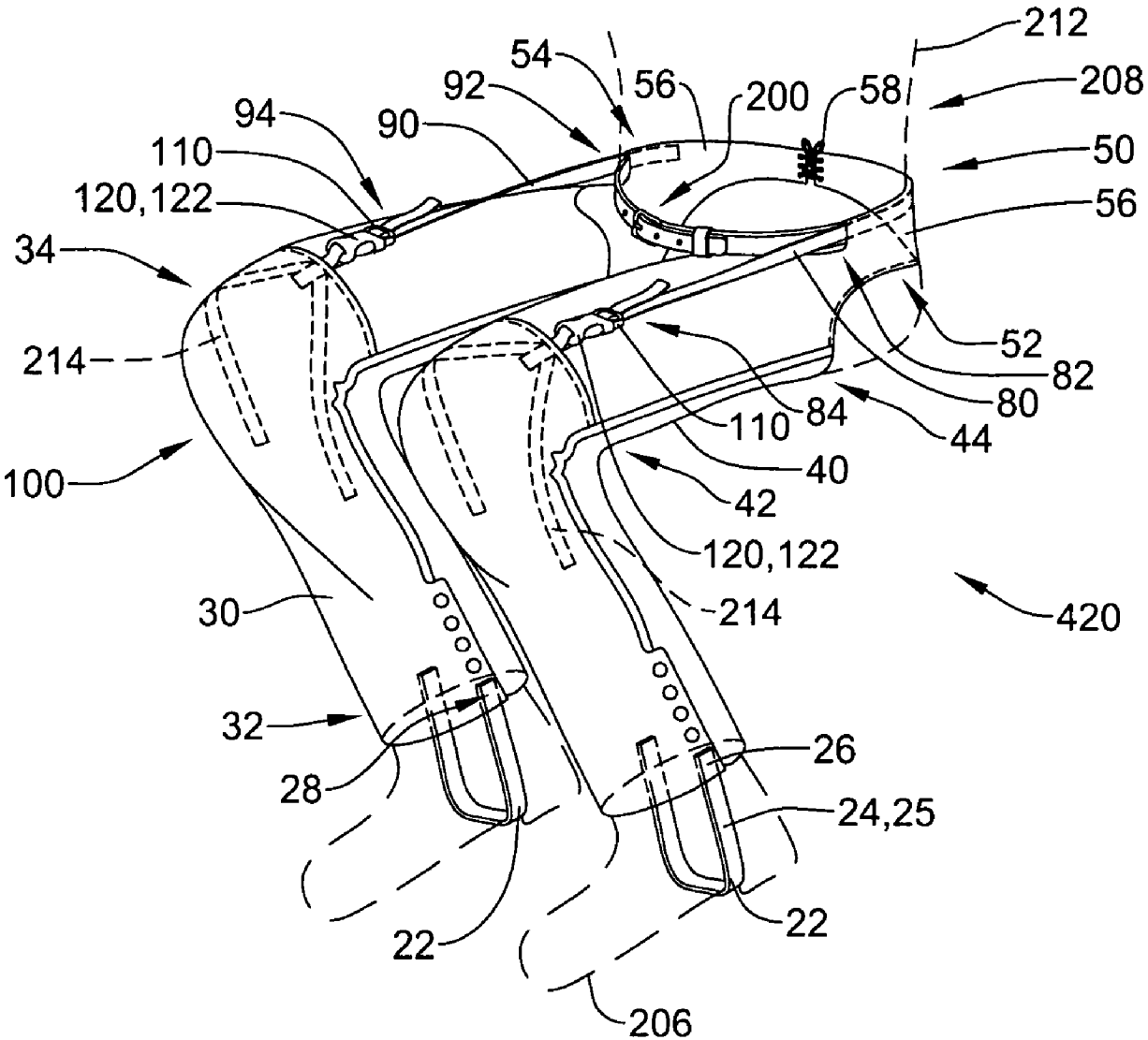
FIG. 4 is a perspective view of a garment in accordance with the present invention disposed about a human figure.

FIG. 4 is a perspective view of a garment 420 in accordance with the present invention. In FIG. 4, garment 420 is disposed about a human figure 212 shown with phantom lines. Garment 420 includes a plurality of anchors 22 disposed about a plurality of feet 206 of human figure 212. In the embodiment of FIG. 4, each anchor 22 comprises a stirrup 24. Each stirrup 24 comprises a strap 25 having a first end 26 and a second end 28. First end 26 and second end 28 of each strap 25 are both fixed to a lower leg portion 30 proximate its distal end 32.

Garment 420 further includes a plurality of upper leg portions 40, each having a distal end 42 and a proximal end 44. As shown in FIG. 4, the distal end of each upper leg portion 40 is fixed to a lower leg portion 30 proximate its proximal end 34. Garment 420 includes a belt assembly 200 and a lumbar support member 50. In the embodiment of FIG. 4, belt assembly 200 and lumbar support member 50 are both disposed about a waist 208 of human figure 212. Lumbar support member 50 is comprised of a plurality of panels 56 fixed to each other by a lace 58.

Lumbar support member 50 also includes a first end 52 and a second end 54. First end 52 of lumbar support member 50 is fixed to a fixed end 82 of a first stay 80. Second end 54 of lumbar support member 50 is fixed to a fixed end 92 of a second stay 90. Lumbar support member 50, first stay 80, and second stay 90 collectively form a lumbar support assembly 100.

A mating member 110 is disposed proximate a free end 84 of the first stay 80. Likewise, an additional mating member 110 is disposed proximate a free end 94 of second stay 90. In the embodiment of FIG. 4, each mating member 110 has been releaseably coupled to a keeper 120.

In the embodiment of FIG. 4, one keeper 120 is disposed proximate proximal end 34 of each lower leg portion 30. In the embodiment of FIG. 4, each keeper 120 includes a locking member 122 and a plurality fixing straps 214. One fixing strap 214 is threaded through locking member 122 and a plurality of fixing straps 214 are fixed to lower leg portion 30.

Figure 5:
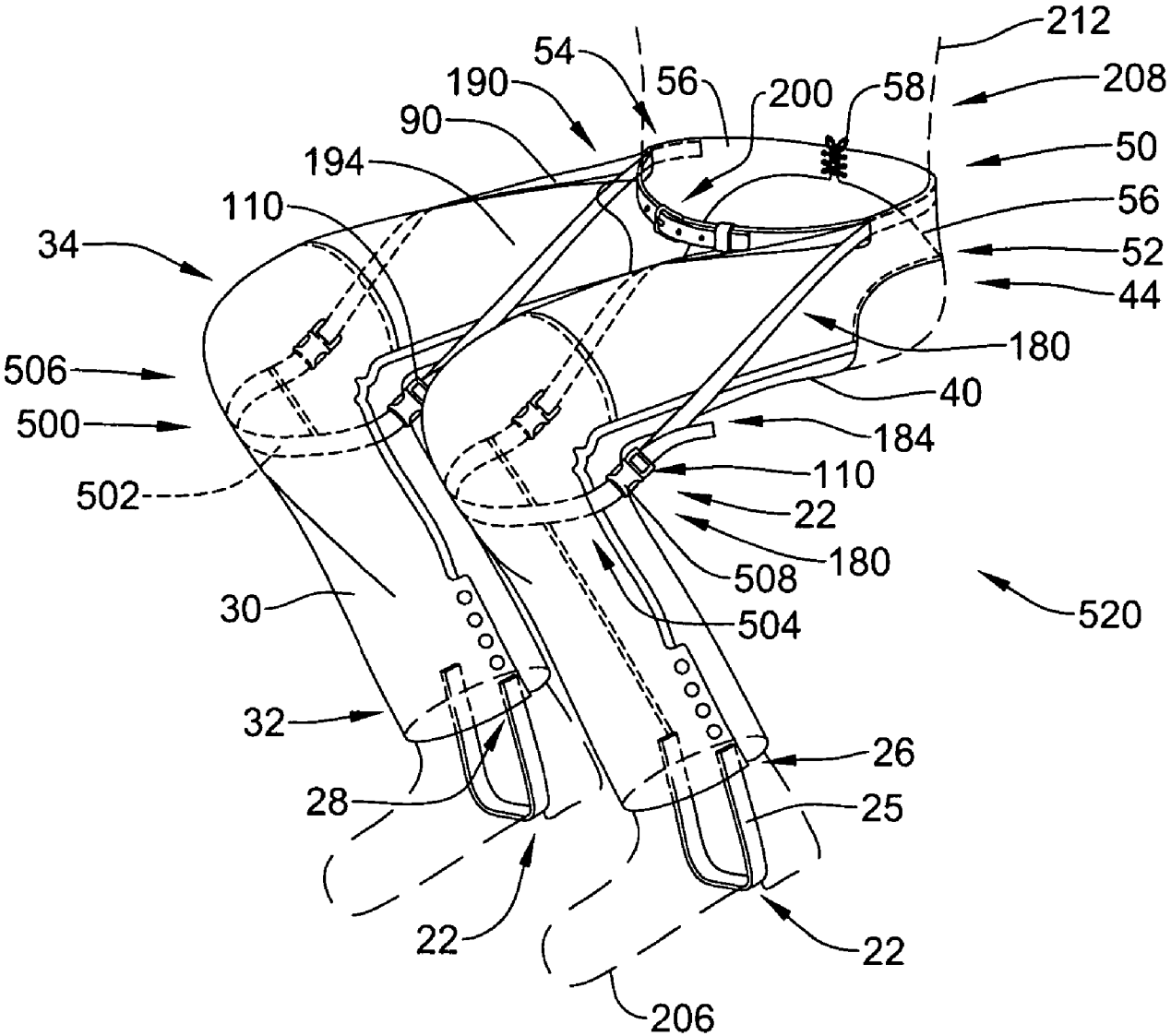
FIG. 5 is a perspective view of a garment in accordance with the present invention disposed about a human figure.

FIG. 5 is a perspective view of a garment 520 in accordance with the present invention. In FIG. 5, garment 520 is disposed about a human figure 212 shown with phantom lines. Garment 520 includes a plurality of anchors 22 disposed about a plurality of feet 206 of human figure 212. In the embodiment of FIG. 5, each anchor 22 comprises a stirrup 24. Each stirrup 24 comprises a strap 25 having a first end 26 and a second end 28. First end 26 and second end 28 of each strap 25 are both fixed to a lower leg portion 30 proximate its distal end 32.

Garment 520 further includes a plurality of upper leg portions 40, each having a distal end 42 and a proximal end 44. As shown in FIG. 5, the distal end of each upper leg portion 40 is fixed to a lower leg portion 30 proximate its proximal end 34. Garment 520 includes a belt assembly 200 and a lumbar support member 50. In the embodiment of FIG. 5, belt assembly 200 and lumbar support member 50 are both disposed about a waist 208 of human figure 212. Lumbar support member 50 is comprised of a plurality of panels 56 fixed to each other by a lace 58.

Lumbar support member 50 also includes a first end 52 and a second end 54. First end 52 of lumbar support member 50 is fixed to a plurality of left stays 180. Second end 54 of lumbar support member 50 is fixed to a plurality of right stays 190. Lumbar support member 50, left stays 180, and right stays 190 collectively form a lumbar support assembly 100.

A mating member 110 is disposed proximate a free end 184 of each left stay 180. Likewise, a mating member 110 is disposed proximate a free end 194 of each right stay 190. In the embodiment of FIG. 5, each mating member 110 has been releaseably coupled to a keeper assembly 500.

In the embodiment of FIG. 5, each keeper assembly 500 includes a keeper strap 502 having a first end 504 and a second end 506. A locking member 508 is fixed to first end 504 of each keeper strap 502. Likewise, a locking member 508 is fixed to the second end 506 of each keeper strap 502. As shown in FIG. 5, each mating member 110 has been releaseably coupled to a locking member 508 of keeper assembly 500. In the embodiment of FIG. 5, each keeper strap 502 is fixed to a lower leg portion 30 of garment 520.

Figure 6:
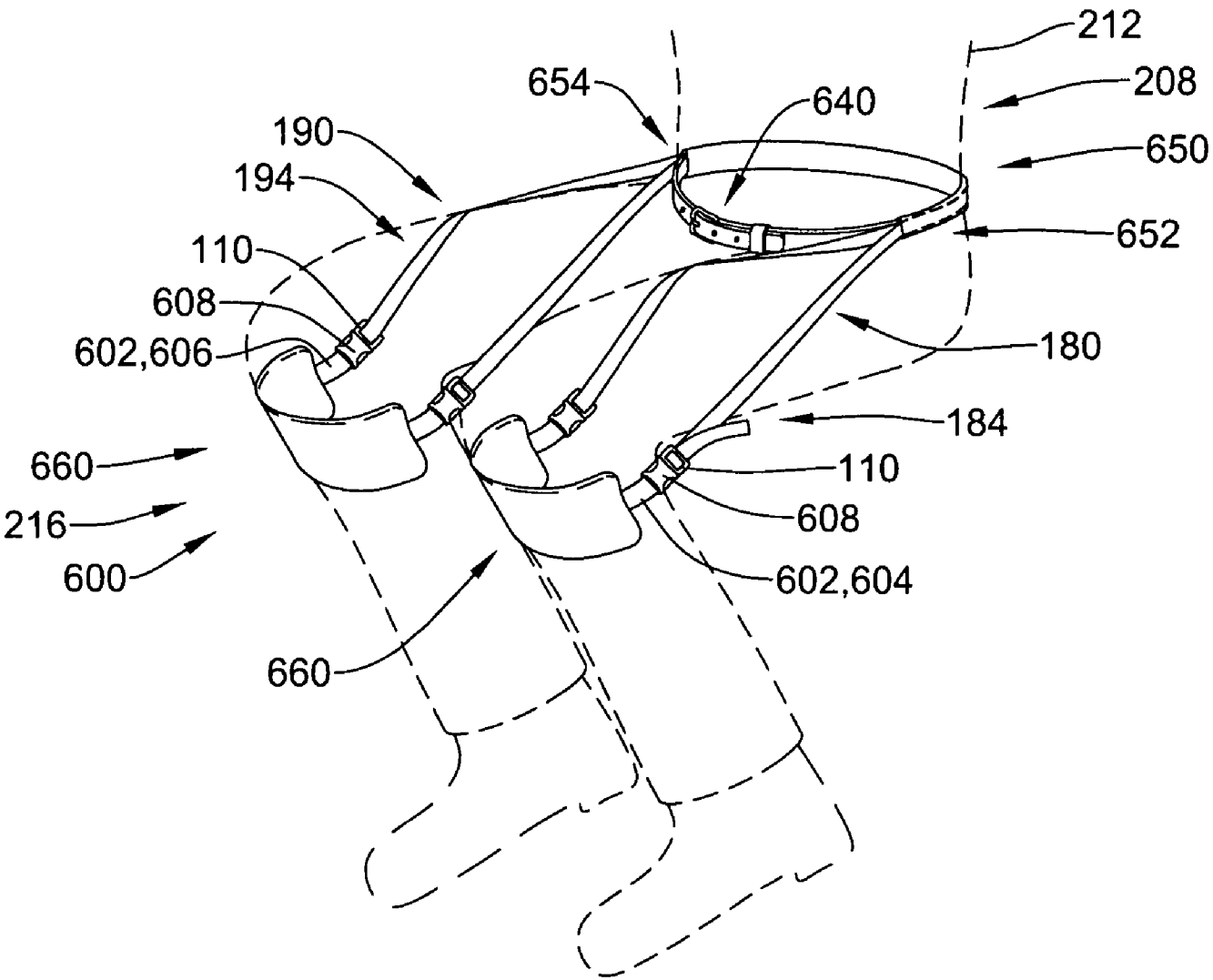
FIG. 6 is a perspective view of a garment in accordance with the present invention disposed about a human figure.

FIG. 6 is a perspective view of a garment 620 in accordance with the present invention. In the embodiment of FIG. 6, a belt assembly 640 and lumbar support member 650 of garment 620 are both disposed about a waist 208 of a human figure 212. Lumbar support member 650 includes a first end 652 and a second end 654. First end 652 of lumbar support member 650 is fixed to a plurality of left stays 180. Second end 654 of lumbar support member 650 is fixed to a plurality of right stays 190. Lumbar support member 650, left stays 180, and right stays 190 collectively form a lumbar support assembly 600.

A mating member 110 is disposed proximate a free end 184 of each left stay 180. Likewise, a mating member 110 is disposed proximate a free end 194 of each right stay 190. In the embodiment of FIG. 6, each mating member 110 has been releaseably coupled to a keeper assembly 660.

In the embodiment of FIG. 6, each keeper assembly 660 includes a keeper strap 602 having a first end 604 and a second end 606. A locking member 608 is fixed to first end 604 of each keeper strap 602. Likewise, a locking member 608 is fixed to the second end 606 of each keeper strap 602. As shown in FIG. 6, each mating member 110 has been releaseably coupled to a locking member 608 of keeper assembly 660. In the embodiment of FIG. 6, each keeper strap 602 is disposed about a knee 216 of human figure 212.

Having thus described the preferred embodiments of the present invention, those of skill in the art will readily appreciate that yet other embodiments may be made and used within the scope of the claims hereto attached. Numerous advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. A garment comprising:

first and second lower leg portions each having a distal and a proximal end;

each lower leg portion including an anchor disposed proximate the distal end thereof;

a first keeper fixed to the first lower leg portion proximate the proximal end thereof;

a second keeper fixed to the second lower leg portion proximate the proximal end thereof;

an elongate lumbar support assembly including a first stay with a free end and a second stay with a free end;

wherein the first stay and the second stay are fixedly attached to the elongate lumbar support assembly;

a first mating member disposed at the free end of the first stay that releasably mates in a complementary manner releasably mate with the first keeper proximate the proximal end of the first lower leg portion;

a second mating member disposed at the free end of the second stay that releasably mates in a complementary manner with the second keeper proximate the proximal end of the second lower leg portion;

first and second upper leg portions;

the first upper leg portion extending between the proximal end of the first lower leg portion and the lumbar support assembly; and the second upper leg portion extending between the proximal end of the second lower leg portion and the lumbar support assembly.

2. The garment of claim 1, wherein the first anchor comprises a stirrup.

3. The garment of claim 1, wherein the first anchor and the second anchor are comprised of stirrups.

4. The garment of claim 1, further including:

first and second belt portions each having a free end and a fixed end;

the fixed ends of the belt portions being fixed to the lumbar support assembly;

the first belt portion defining a plurality of holes; and a buckle disposed at the free end of the second belt portion and adapted to releasably mate with the plurality of holes defined by the first belt portion.

5. The garment of claim 1, wherein the first keeper and the second keeper each include a keeper and a fixing strap.

6. The garment of claim 1, wherein the first keeper comprises the female portion of a two-part buckle.

7. The garment of claim 1, wherein the first keeper and the second keeper each comprise the female portion of a two-part buckle.

8. The garment of claim 1, wherein the first mating member comprises the male portion of a two-part buckle.

9. The garment of claim 1, wherein the first mating member and the second mating member each comprise the male portion of a two-part buckle.

10. The garment of claim 1, wherein the stays are comprised of webbing.

11. The garment of claim 1, wherein the stays are comprised of metal chain.

12. A garment comprising:

first and second lower leg portions each having a distal and a proximal end;

first and second stirrups each having at least one end;

at least one end of the first stirrup being fixed to the first lower leg portion proximate the distal end thereof;

at least one end of the second stirrup being fixed to the second lower leg portion proximate the distal end thereof;

a first locking member fixed to the first lower leg portion proximate the proximal end thereof;

a second locking member fixed to the second lower leg portion proximate the proximal end thereof;

first and second stays each having a free end and a fixed end;

a first mating member disposed at the free end of the first stay that releasably mates in a complementary manner with the first locking member;

a second mating member disposed at the free end of the second stay that releasably mates in a complementary manner with the second locking member;

a lumbar support member having a first end and a second end;

the fixed end of the first stay being fixed to the first end of the lumbar support member; and the fixed end of the second stay being fixed to the second end of the lumbar support member.

13. The garment of claim 12, further including:

first and second upper leg portions;

the first upper leg portion extending between the proximal end of the first lower leg portion and the lumbar support member; and the second upper leg portion extending between the proximal end of the second lower leg portion and the lumbar support member.

14. The garment of claim 13, further including:

first and second belt portions each having a free end and a fixed end;

the fixed ends of the belt portions being fixed to the lumbar support member;

the first belt portion defining a plurality of holes; and a buckle disposed at the free end of the second belt portion and adapted to releasably mate with the plurality of holes defined by the first belt portion.

15. The garment of claim 12, wherein the first locking member and the second locking member each comprise the female portion of a two-part buckle.

16. The garment of claim 12, wherein the stays are comprised of webbing.

17. The garment of claim 12, wherein the stays are comprised of metal chain.

18. A garment comprising:

first and second lower leg portions each having a distal and a proximal end;

first and second stirrups each having at least one end;

at least one end of the first stirrup being fixed to the first lower leg portion proximate the distal end thereof;

at least one end of the second stirrup being fixed to the second lower leg portion proximate the distal end thereof;

a first locking member fixed to the first lower leg portion proximate the proximal end thereof by a first anchor strap;

a second locking member fixed to the second lower leg portion proximate the proximal end thereof by a second anchor strap;

first and second stays each having a free end and a fixed end;

a first mating member disposed at the free end of the first stay that releasably mates in a complementary manner with the first locking member;

a second mating member disposed at the free end of the second stay that releasably mates in a complementary manner to releasably mate with the second locking member;

a lumbar support member having a first end and a second end;

the fixed end of the first stay being fixed to the first end of the lumbar support member;

the fixed end of the second stay being fixed to the second end of the lumbar support member;

first and second belt portions each having a free end and a fixed end;

the first belt portion defining a plurality of holes;

a buckle disposed at the free end of the second belt portion and adapted to releasably mate with the plurality of holes defined by the first belt portion;

first and second upper leg portions;

the first upper leg portion extending between the proximal end of the first lower leg portion and the lumbar support member; and the second upper leg portion extending between the proximal end of the second lower leg portion and the lumbar support member.

* * * * *